US012181245B1

(12) United States Patent
Chiang

(10) Patent No.: US 12,181,245 B1
(45) Date of Patent: Dec. 31, 2024

(54) ROTATABLE FIREARM STOCK

(71) Applicant: GRIP PLUS INC, Menlo Park, CA (US)

(72) Inventor: Sai Ming Chiang, Redwood City, CA (US)

(73) Assignee: GRIP PLUS INC., Menlo Park, CA (US)

( * ) Notice: Subject to any disclaimer, the term of this patent is extended or adjusted under 35 U.S.C. 154(b) by 0 days.

(21) Appl. No.: 18/413,343

(22) Filed: Jan. 16, 2024

(51) Int. Cl.
*F41C 23/14* (2006.01)
*F41C 23/16* (2006.01)

(52) U.S. Cl.
CPC ..... *F41C 23/14* (2013.01); *F41C 23/16* (2013.01)

(58) Field of Classification Search
CPC ..... F41C 23/14; F41C 23/16
See application file for complete search history.

(56) References Cited

U.S. PATENT DOCUMENTS 8,499,483 B2 * 8/2013 Quaedpeerds ..... F41C 23/20 42/73
8,601,734 B1 * 12/2013 Hopkins ..... F41C 23/14 42/71.01
8,776,423 B2 * 7/2014 Paquette ..... F41C 23/14 42/73
9,696,110 B2 * 7/2017 Hollis ..... F41C 23/12
9,829,272 B2 * 11/2017 Brown ..... F41C 23/04
10,156,421 B2 * 12/2018 Smith ..... F41C 23/14
10,739,099 B2 * 8/2020 Bowman ..... F41C 23/16
10,907,931 B2 * 2/2021 Schoenborn ..... F41C 23/04
10,942,004 B2 * 3/2021 Grenier ..... F41C 23/16
11,162,758 B1 * 11/2021 Lee ..... F41C 23/10
11,255,634 B2 * 2/2022 Golan ..... F41A 17/46
11,371,801 B2 * 6/2022 Shinkle ..... F41C 23/14
11,385,020 B2 * 7/2022 Grenier ..... F41C 23/14
11,607,795 B2 * 3/2023 Brauer ..... B25G 3/08
11,639,834 B2 * 5/2023 Wiedemann ..... F41A 19/10 42/14
11,953,289 B2 * 4/2024 Angers, Jr. ..... F41C 23/14
11,965,708 B2 * 4/2024 Mebberson ..... F41C 23/14
2018/0231346 A1 * 8/2018 Kent ..... F41C 23/14
2020/0340772 A1 * 10/2020 Bowman ..... F41A 23/10

* cited by examiner

*Primary Examiner* — Michelle Clement
(74) *Attorney, Agent, or Firm* — Parsons Behle & Latimer

(57) ABSTRACT

Apparatus, systems, and methods for a rotatable firearm stock. The stock includes a first grip portion configured to be attached to a firearm receiver. The stock includes a second grip portion having a first axis of rotation. The stock includes a first connection interface between the first grip portion and the second grip portion. The first connection interface enables the second grip portion to be connected to the first grip portion in more than one angular orientation about the first axis of rotation. The second grip portion includes a second axis of rotation. The stock includes a butt stock positioned adjacent to the second grip portion. The stock includes a second connection interface between the second grip portion and the butt stock. The second connection interface enables the second grip portion to be connected to the butt stock in more than one angular orientation about the second axis of rotation.

15 Claims, 10 Drawing Sheets

ROTATABLE FIREARM STOCK

FIELD OF THE DISCLOSURE

The embodiments described herein relate to apparatuses, systems, and methods for a rotatable firearm stock.

BACKGROUND

Description of the Related Art

There are numerous firearm grip stocks that may be connected to a firearm receiver. A front portion of the grip stock is connected to the end of a firearm receiver and the rear portion of the grip stock may be connected to a butt stock. Although the grip stock is vertically aligned with the receiver and butt stock when connected, the user's grip on the grip stock may tilt or cant the weapon when fired. For example, the user's hand may end up canting the firearm from between 1 degree to 6 degrees, or more, offset from vertical. The user may be able to view himself or herself in a mirror to correct the unwanted cant of the firearm. However, the user may revert back to the unwanted canting of the firearm during actual operation of the firearm. The canting of the firearm causes the sights located on the top of the firearm to be moved off of vertical orientation, which may cause diminished performance for the user especially in competitive shooting competitions such as professional shotgun shooting competitions, or the like. Other disadvantages exist.

SUMMARY

The present disclosure is directed to apparatuses, systems, and methods for a rotatable firearm stock.

An embodiment of the disclosure is a firearm stock. The firearm stock includes a first grip portion. The first grip portion is configured to attach to a firearm receiver. The firearm stock includes a second grip portion having a first end, a second end, and a first axis of rotation. The first end of the second grip portion is positioned adjacent to the first grip portion. The firearm stock includes a first connection interface between the first grip portion and the first end of the second grip portion. The first connection interface enables the second grip portion to be connected to the first grip portion in more than one angular orientation about the first axis of rotation of the second grip portion.

The first grip portion may include a longitudinal centerline. The first axis of rotation may be aligned with the longitudinal centerline. The second grip portion may include a second axis of rotation. The firearm stock may include a butt stock positioned adjacent to the second end of the second grip portion. The firearm stock may include a second connection interface between the second end of the second grip portion and the butt stock. The second connection interface may enable the second grip portion to be connected to the butt stock in more than one angular orientation about the second axis of rotation of the second grip portion.

The first connect interface may include a first plate and a cog on a surface of the first plate, the cog includes a first plurality of teeth. The first connect interface may include a second plate, the second plate having a central opening, the central opening includes a second plurality of teeth along the central opening. The second plurality of teeth may be configured to engage the first plurality of teeth on the cog. The second plate may be connected to the first plate in a plurality of angular orientations in which the second plurality of teeth engage the first plurality of teeth to selectively angularly retain the second plate with respect to the first plate. The first plate may be connected to the first grip portion and the second plate may be connected to the first end of the second grip portion. The first plurality of teeth of the cog and the second plurality of teeth of the central opening may be configured to enable the second grip portion to be orientated between −20 degrees offset and 20 degrees offset with respect to the first grip portion. The first plurality of teeth of the cog and the second plurality of teeth of the central opening may be configured to enable the second grip portion to be rotated in 4-degree increments between −20 degrees offset and 20 degrees offset with respect to the first grip portion.

The second connection interface may include a projection, the projection includes a third plurality of teeth. The second connection interface may include a circular recess, the circular recess includes a fourth plurality of teeth, the fourth plurality of teeth are configured to engage the third plurality of teeth of the projection. The projection may be inserted into the circular recess in a plurality of angular orientations in which the fourth plurality of teeth engage the third plurality of teeth to selectively retain the projection in place with respect to the circular recess. The circular recess may be positioned on the second end of the second grip portion and the projection may be on an end of the butt stock. The third plurality of teeth of the projection and the fourth plurality of teeth of the circular recess may be configured to enable the second grip portion to be orientated between −20 degrees offset and 20 degrees offset with respect to the butt stock. The third plurality of teeth of the projection and the fourth plurality of teeth of the circular recess may be configured to enable the second grip portion to be rotated in 4-degree increments between −20 degrees offset and 20 degrees offset with respect to the butt stock.

An embodiment of the disclosure is a firearm stock system. The firearm stock system includes a first grip portion. The first grip portion includes a first end and a second end, the first grip portion being configured to attach to a firearm receiver. The firearm stock system includes a second grip portion having a first end, a second end, a first axis of rotation, and a second axis of rotation, the first end being positioned adjacent to the first grip portion. The firearm stock system includes a first connection interface between the first grip portion and the first end of the second grip portion. The first connection interface enables the second grip portion to be connected to the first grip portion in more than one angular orientation about the first axis of rotation of the second grip portion. The firearm stock system includes a butt stock. The butt stock includes a first end and a second end. The butt stock is positioned adjacent to the second end of the second grip portion. The firearm stock system includes a second connection interface between the second end of the second grip portion and the butt stock. The second connection interface enables the second grip portion to be connected to the butt stock in more than one angular orientation about the second axis of rotation of the second grip portion.

The firearm stock system may include a length from the first end of the first grip portion and the second end of the butt stock, wherein the length does not change when the second grip portion is rotated about the first axis of rotation and is rotated about the second axis of rotation. The first connection interface of the firearm stock system may include a first plate and a cog on a surface of the first plate. The cog includes a first plurality of teeth. The first connection interface may include a second plate. The second plate had a central opening, the central opening includes a second plurality of teeth along the central opening. The second plurality of teeth may be configured to engage the first plurality of teeth on the cog. The second plate may be connected to the first plate in a plurality of angular orientations in which the second plurality of teeth engage the first plurality of teeth to selectively angularly retain the second plate with respect to the first plate.

The second connection interface of the firearm stock system may include a projection. The projection includes a third plurality of teeth. The second connection interface of the firearm stock system may include a circular recess. The circular recess includes a fourth plurality of teeth, the fourth plurality of teeth may be configured to engage the third plurality of teeth of the projection. The projection may be inserted into the circular recess in a plurality of angular orientations in which the fourth plurality of teeth engage the third plurality of teeth to selectively retain the projection in place with respect to the circular recess. The first plurality of teeth of the cog and the second plurality of teeth of the central opening may be configured to enable the second grip portion to be orientated between −20 degrees offset and 20 degrees offset with respect to the first grip portion. The third plurality of teeth of the projection and the fourth plurality of teeth of the circular recess may be configured to enable the second grip portion to be orientated between −20 degrees offset and 20 degrees offset with respect to the butt stock.

An embodiment of the disclosure is a method for compensating for a cant of a firearm. The method includes disconnecting a first grip portion of a firearm stock from a second grip portion of the firearm stock, the second grip portion having a first angular orientation with respect to the first grip portion about a first axis of rotation of the second grip portion. The method includes rotating the second grip portion about the first axis of rotation with respect to the first grip portion to a second angular orientation. The method includes connecting the second grip portion to the first grip portion in the second angular orientation.

The method may include disconnecting the second grip portion of the firearm stock from a butt stock of the firearm stock, the second grip portion having the first angular orientation with respect to the butt stock about a second axis of rotation of the second grip portion. The method may include rotating the second grip portion about the second axis of rotation with respect to the butt stock to the second angular orientation. The method may include connecting the second grip portion to the butt stock in the second angular orientation. The second angular orientation may compensate for the cant.

Additional embodiments exist.

Figure 1A:
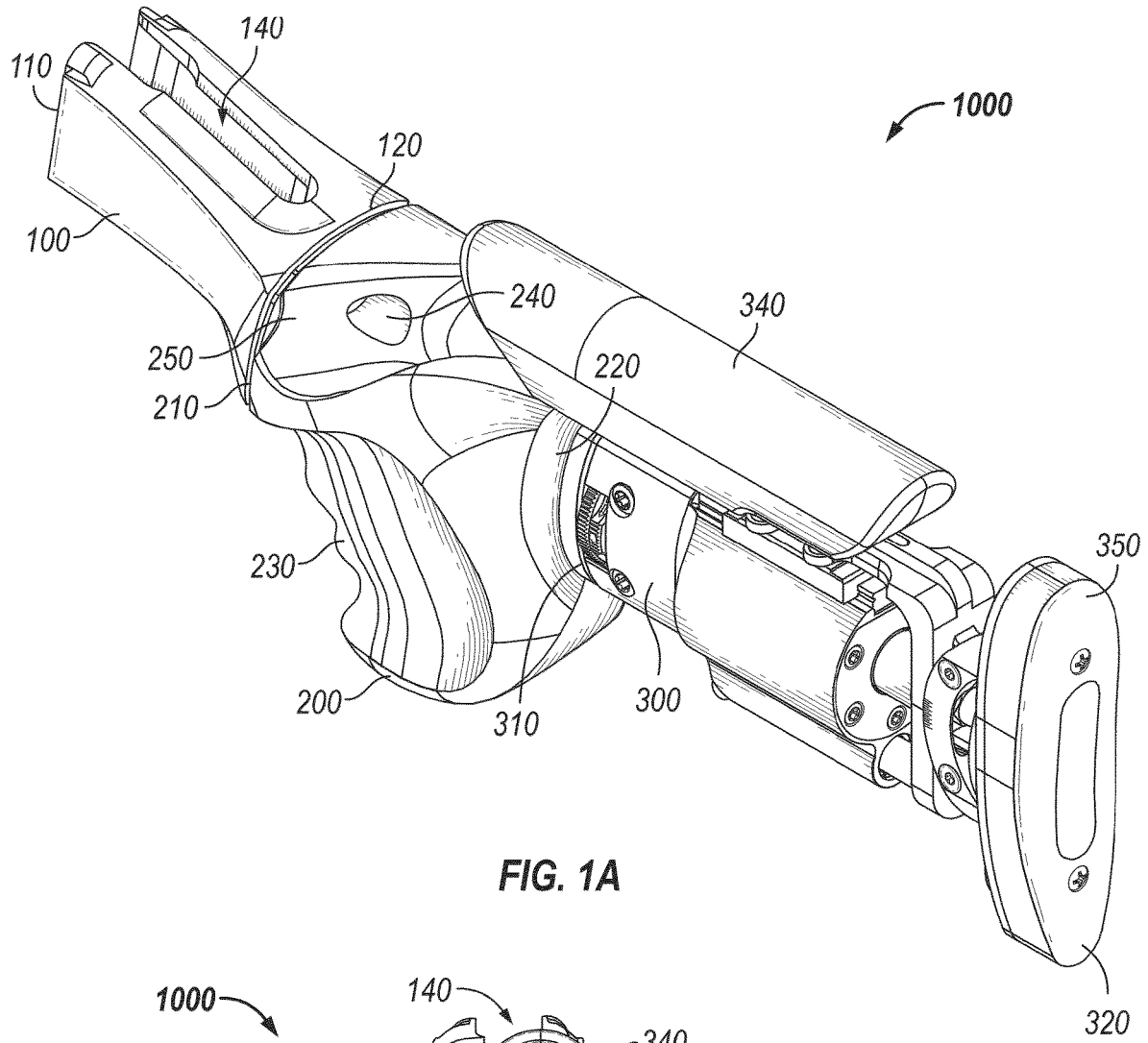
FIGS. 1A and 1B show an embodiment of a rotatable firearm stock assembly comprising a first grip portion, a second grip portion, and a butt stock with the second grip portion in a first angular orientation with respect to the first grip portion and the butt stock.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 1B:
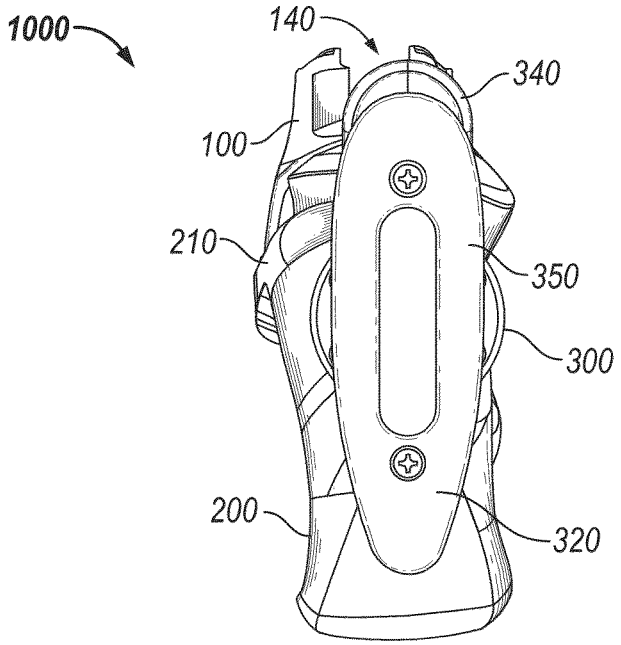

FIGS. 1A and 1B show an embodiment of a rotatable firearm stock assembly 1000 comprising a first grip portion 100, a second grip portion 200, and a butt stock 300 with the second grip portion 200 in a first angular orientation with respect to the first grip portion 100 and the butt stock 300. In the first angular orientation, the second grip portion 200 is axially aligned with first grip portion 100 as well as being axially aligned with the butt stock 300. In this orientation, the second grip portion 200 does not compensate for any cant of the firearm stock assembly 1000. The first grip portion 100 includes a first end 110 and a second end 120. The first grip portion 100 include a slot 140 that enables the insertion of a firearm receiver that may be connected to the first grip portion 100 as would be appreciated by one of ordinary skill in the art having the benefit of this disclosure.

The second grip portion 200 includes a first end 210 and a second end 220. The first end 210 of the second grip portion 200 is connected to the second end 120 of the first grip portion 100. A first connection interface 400 (shown in FIGS. 4 and 5) enables the second grip portion 200 to rotate with respect to the first grip portion 100 as discussed herein. The second grip portion 200 includes a grip 230 that enables a user to grip the firearm stock assembly 1000. The second grip portion 200 includes an opening, or aperture, 240 through which a fastener may be inserted to secure the firearm stock assembly 1000 to a receiver of a firearm. The second grip portion 200 includes a thumb slot 250.

The butt stock 300 is connected to the second end 220 of the second grip portion 200. A second connection interface 500 (shown in FIGS. 4 and 5) enables the second grip portion 200 to rotate with respect to the butt stock 300 as discussed herein. The butt stock 300 includes a first end 310 and a second end 320. A butt pad 350 is located at the second end 320. The butt stock 300 include an adjustable comb 340. The comb 340 may be an automatically adjusting comb as disclosed in U.S. Pat. No. 8,863,427 entitled Automatically Adjustable Comb for a Firearm, which is incorporated by reference herein in its entirety. The butt stock 300 may include a recoil system. For example, the butt stock 300 may include a recoil system as disclosed in U.S. Pat. No. 9,417,032 entitled Firearm Stock and Recoil System or U.S. Pat. No. 9,672,193 entitled Firearm Stock and Recoil System, both of which are incorporated by reference herein in their entirety.

Figure 2A:
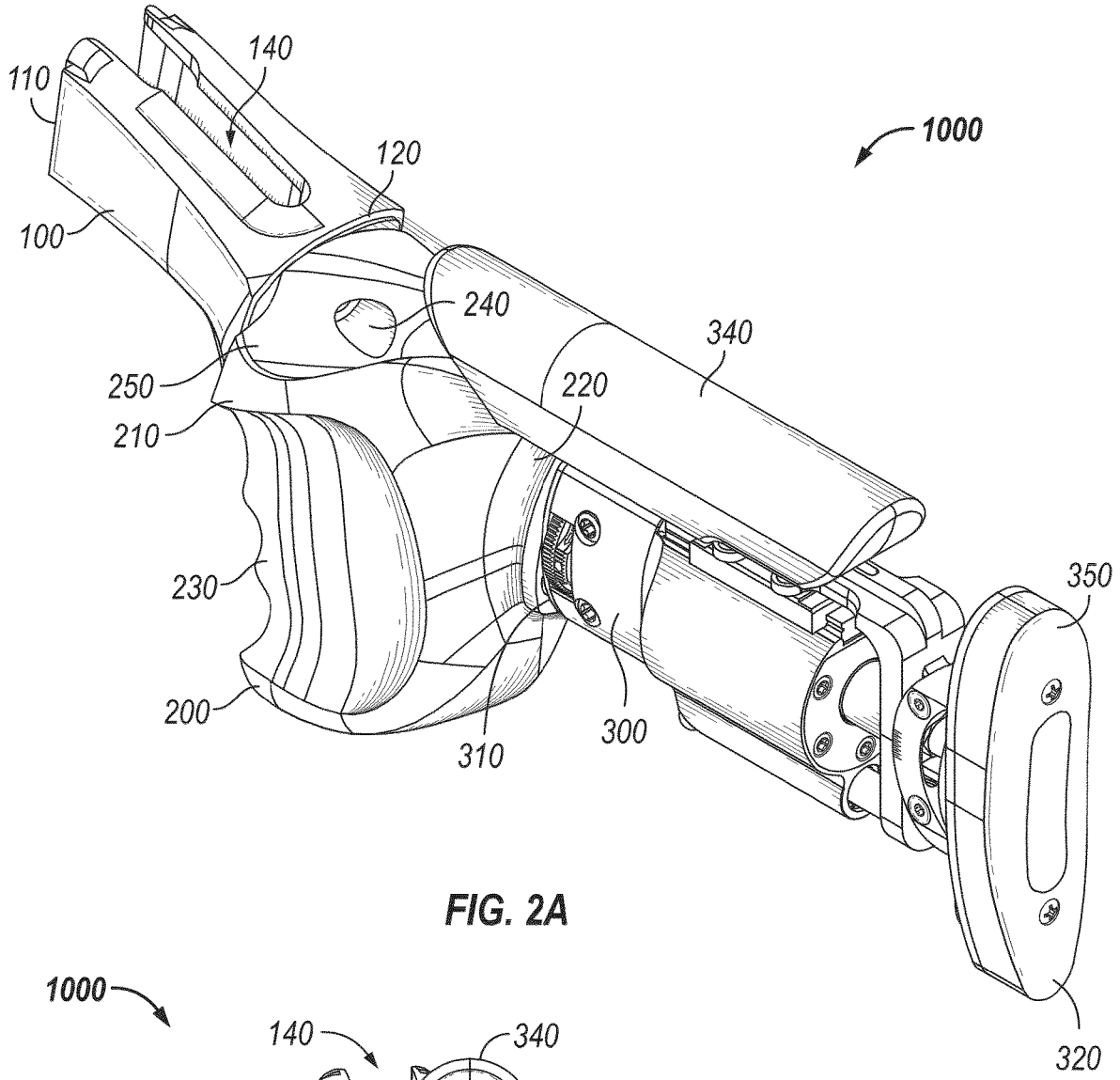
FIGS. 2A and 2B show an embodiment of a rotatable firearm stock assembly comprising a first grip portion, a second grip portion, and a butt stock with the second grip portion in a second angular orientation with respect to the first grip portion and the butt stock.
Figure 2B:
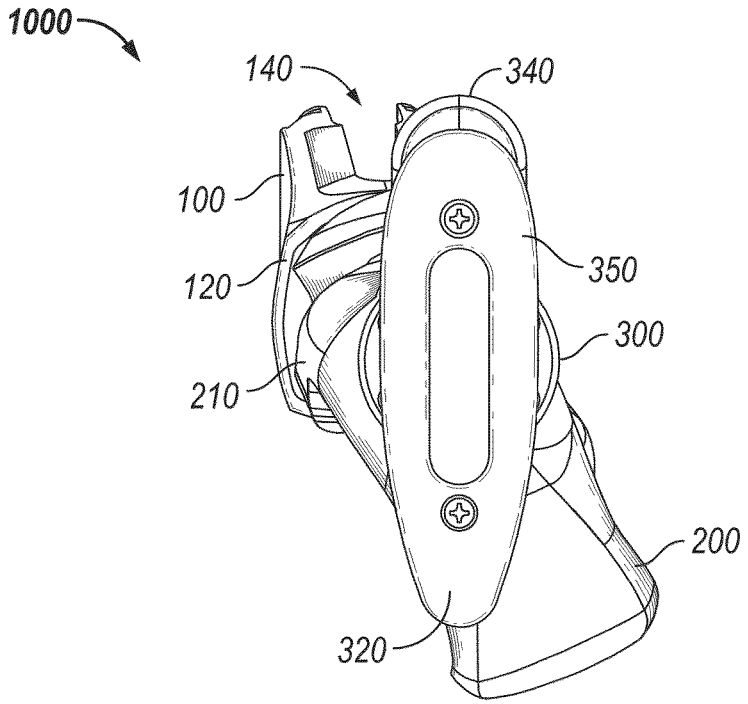

FIGS. 2A and 2B show an embodiment of a rotatable firearm stock assembly 1000 comprising a first grip portion 100, a second grip portion 200, and a butt stock 300 with the second grip portion 200 in a second angular orientation with respect to the first grip portion 100 and the butt stock 300. In the second angular orientation, the second grip portion 200 has been rotated a positive 20 degrees with respect to the first grip portion 100 as well as the butt stock 300. In this orientation, the second grip portion 200 compensates for a cant of the firearm stock assembly 1000 in a negative 20 degrees. As used herein, a positive degree rotation is a clockwise rotation of the second grip portion 200 when viewed from the butt stock 300 and a negative degree rotation is a counter-clockwise rotation of the second grip portion 200 when viewed from the butt stock 300. The amount of rotation of the second grip portion 200 may be varied as discussed herein. The second grip portion 200 is shown rotated clockwise at 20 degrees for illustrative purposes and the amount of the degree of rotation may be varied as would be appreciated by one of ordinary skill in the art. For example, the second grip portion 200 may be configured to rotate in one-degree increments and may compensate for any degree of negative cant as would be appreciated by one of ordinary skill in the art having the benefit of this disclosure.

Figure 3A:
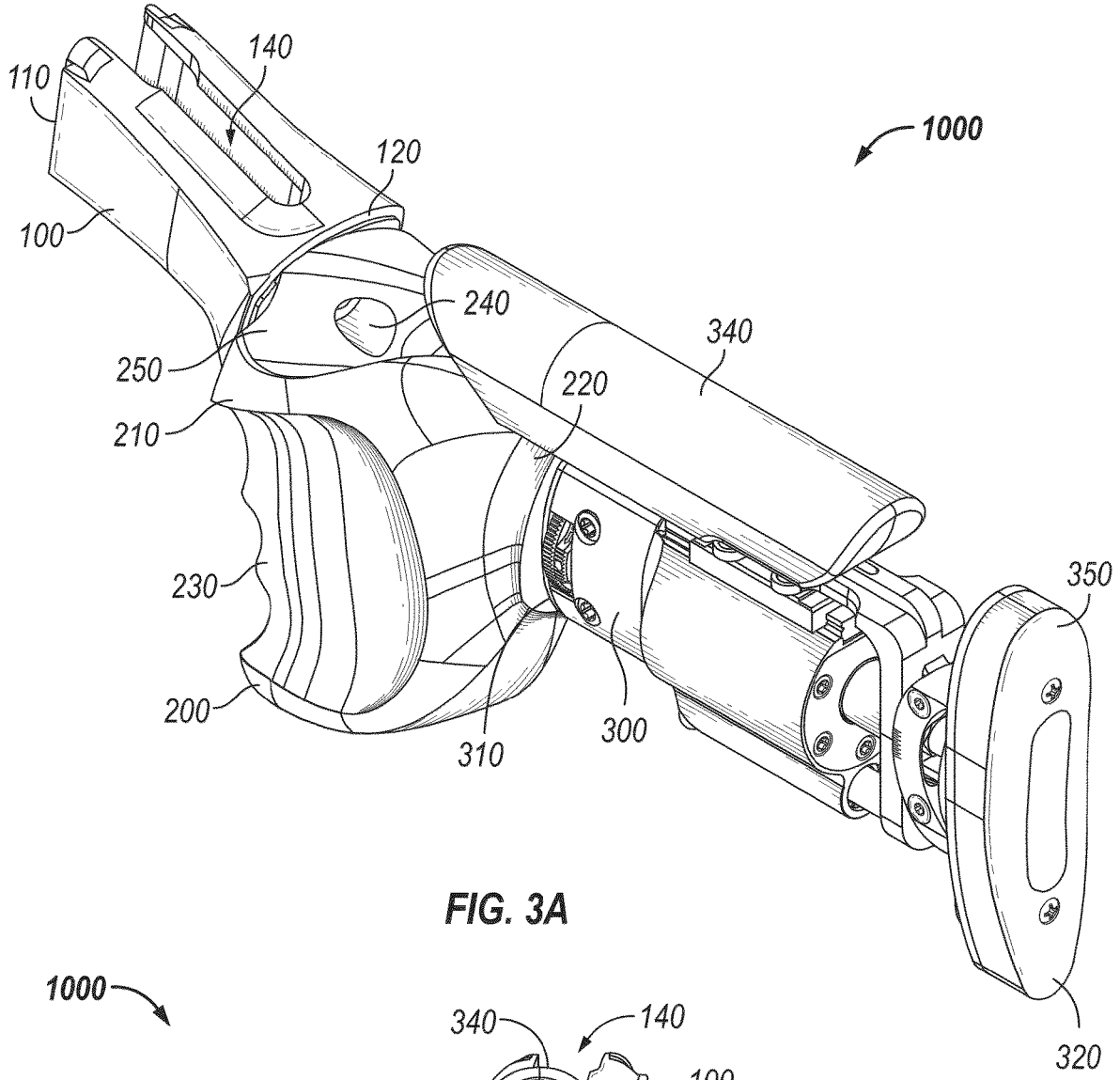
FIGS. 3A and 3B show an embodiment of a rotatable firearm stock assembly comprising a first grip portion, a second grip portion, and a butt stock with the second grip portion in a third angular orientation with respect to the first grip portion and the butt stock.
Figure 3B:
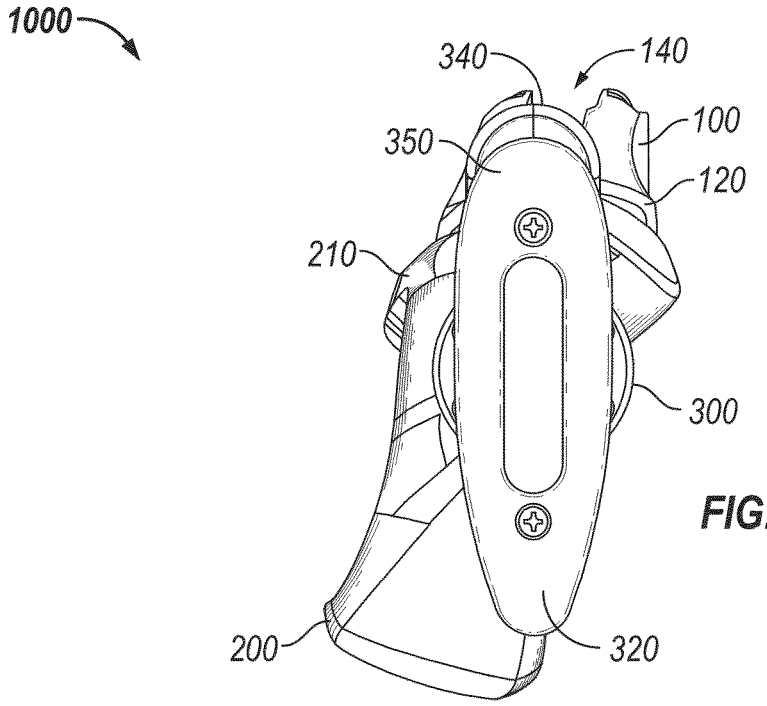

FIGS. 3A and 3B show an embodiment of a rotatable firearm stock assembly 1000 comprising a first grip portion 100, a second grip portion 200, and a butt stock 300 with the second grip portion 200 in a third angular orientation with respect to the first grip portion 100 and the butt stock 300. In the third angular orientation, the second grip portion 200 has been rotated a negative 20 degrees with respect to the first grip portion 100 as well as the butt stock 300. In this orientation, the second grip portion 200 compensates for a cant of the firearm stock assembly 1000 in a negative 20 degrees. The amount of rotation of the second grip portion 200 may be varied as discussed herein. The second grip portion 200 is shown rotated counter-clockwise at 20 degrees for illustrative purposes and the amount of the degree of rotation may be varied as would be appreciated by one of ordinary skill in the art. For example, the second grip portion 200 may be configured to rotate in one-degree increments and may compensate for any degree of positive cant as would be appreciated by one of ordinary skill in the art having the benefit of this disclosure.

When a user grips a firearm, such as a shotgun, the position of the user's hand may cause the firearm to cant in a positive or negative direction from vertical alignment, which moves the sights located on the top of the firearm. The amount of cant may be measured and the rotatable firearm stock 1000 of the present disclosure may be used to compensate for the undesired cant of the firearm. For example, a user may naturally cant the weapon 12 degrees in a clockwise direction when viewed from the rear of the firearm. The second grip portion 200 of the firearm stock 1000 may be rotated 12 degrees in a counter-clockwise direction with respect to the first grip portion 100 and the butt stock 300 and the second grip portion 200 may be connected to both the first grip portion 100 and the butt stock 300 in this angular orientation to compensate for the undesired cant. In another example, a user may naturally cant the weapon 8 degrees in a counter-clockwise direction when viewed from the rear of the firearm. The second grip portion 200 of the firearm stock 1000 may be rotated 8 degrees in a clockwise direction with respect to the first grip portion 100 and the butt stock 300 and the second grip portion 200 may be connected to both the first grip portion 100 and the butt stock 300 in this angular orientation to compensate for the undesired cant.

Figure 4:
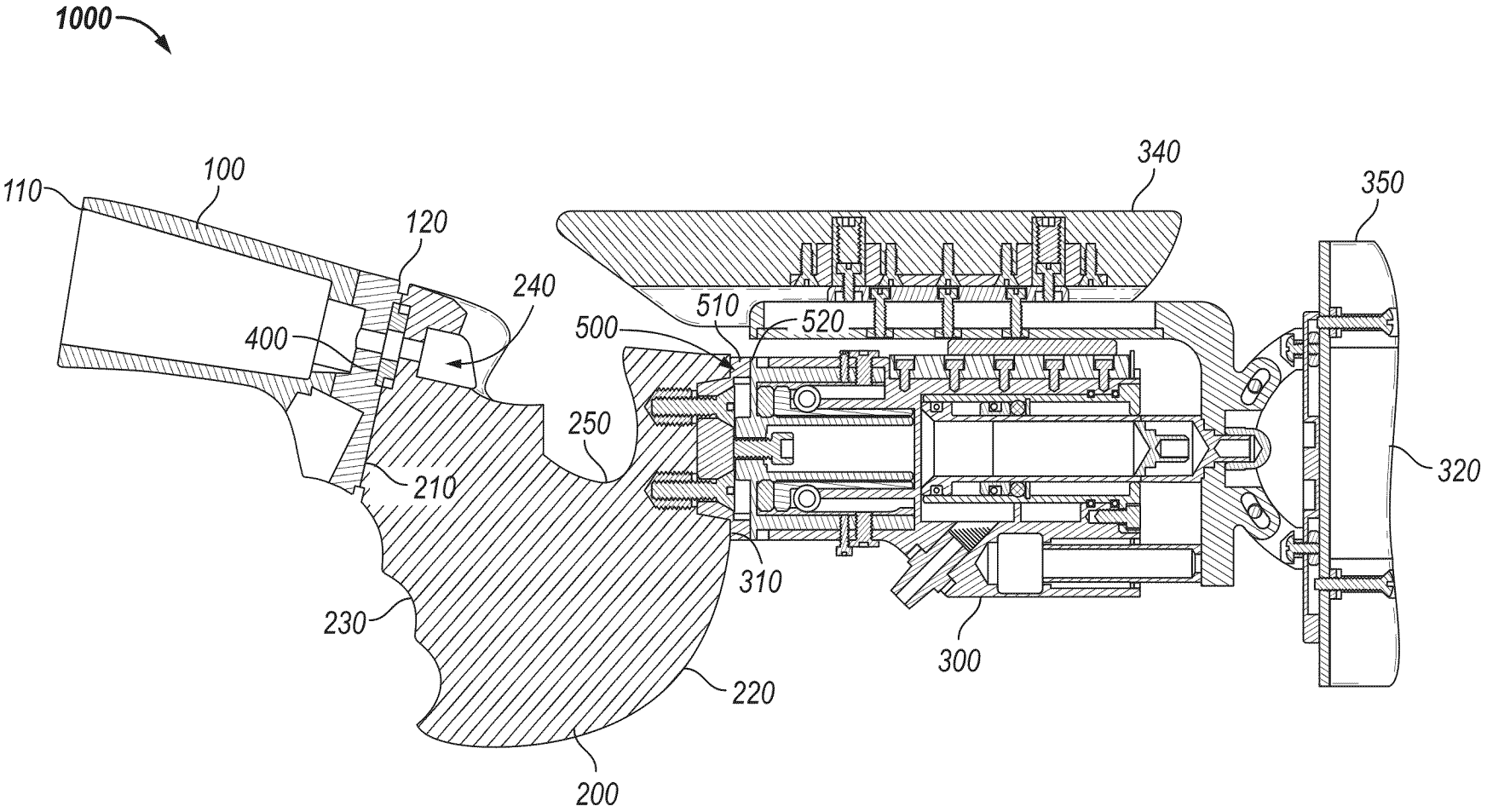
FIG. 4 shows a cross-sectional view of an embodiment of a rotatable firearm stock assembly.
Figure 5:
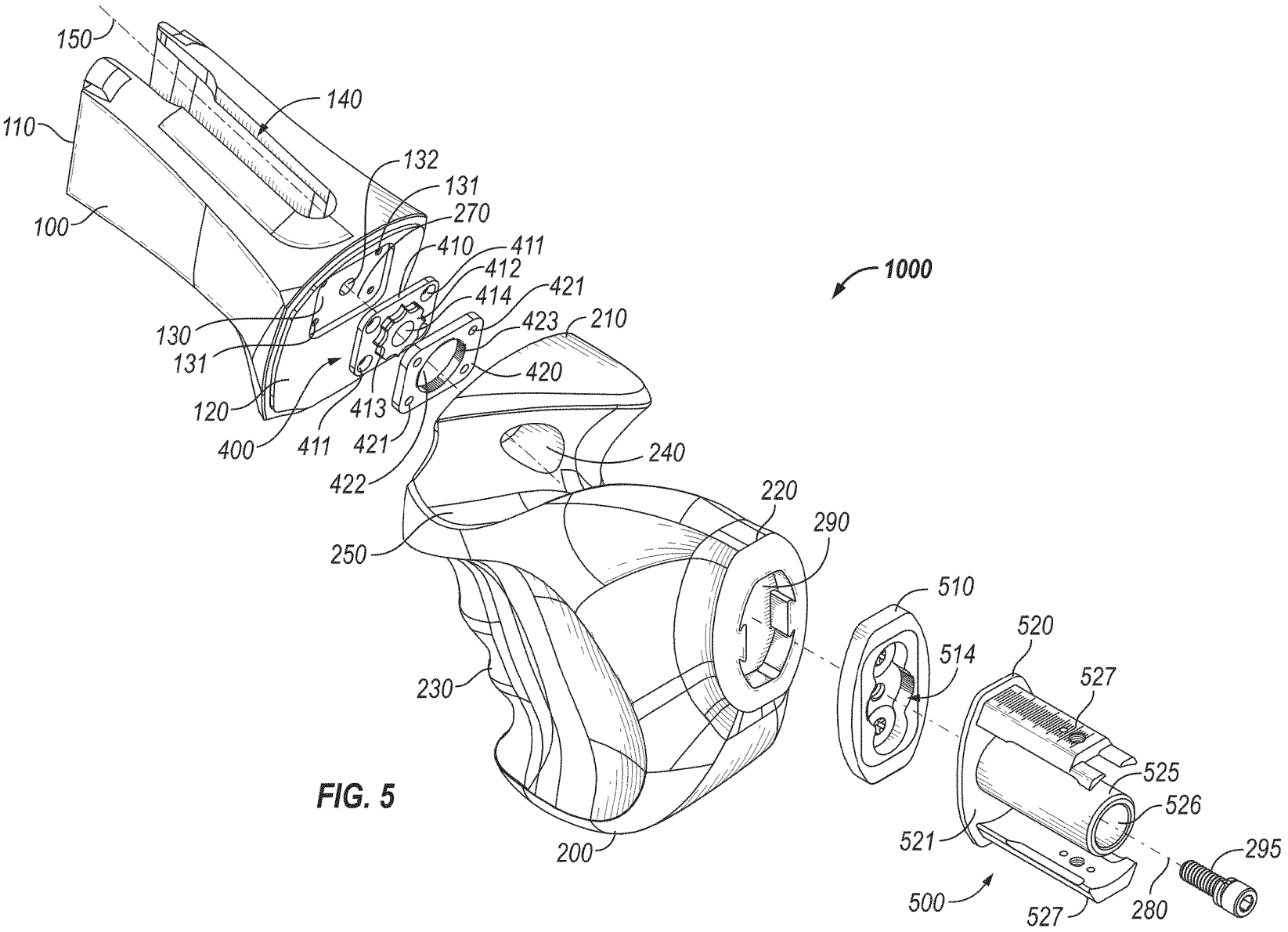
FIG. 5 shows an exploded view of a portion of a rotatable firearm stock assembly.

FIG. 4 shows a cross-sectional view of an embodiment of a rotatable firearm stock assembly 1000. FIG. 5 shows an exploded view of the firearm stock 1000 with the butt stock 300 not shown. The firearm stock 1000 includes a first grip portion 100. The first grip portion 100 is configured to attach to a firearm receiver. The first grip portion 100 has a first end 110 and a second end 120 positioned adjacent to a second grip portion 200. The first grip portion includes a slot, or channel, 140 into which a firearm receiver may be inserted as would be appreciated by one of ordinary skill in the art having the benefit of this disclosure. The second end 120 of the first grip portion 100 includes a recess 130. The recess 130 is configured to receive a first plate 410 of a first connection interface 400. The first connection interface 400 enables the second grip portion 200 to be connected to the first grip portion 100 at various angular orientations as discussed herein.

The first connect interface 400 includes a first plate 410 and a cog 412 on a surface of the first plate 410. The cog 412 includes a first plurality of teeth 413. The first plate 410 include a plurality of openings 411 that enable a fastener to be inserted through to secure the first plate 410 within the recess 130 in the second end 120 of the first grip portion 100. The cog 412 includes an opening 414 to enable a fastener to pass through to connect the firearm stock 1000 to the receiver of a firearm.

The first connect interface 400 includes a second plate 420. The second plate 420 has a central opening 422 and includes a second plurality of teeth 423 along the central opening 422. A fastener may be inserted through an opening 240 of the second grip portion 200, the central opening 422 of the second plate 420, the opening 414 of the first plate, and the central aperture 132 in the recess 130 in the second end 120 of the first grip portion 100 to connect the stock 1000 to the receiver of a firearm, such as a shotgun. The second plurality of teeth 423 are configured to engage the first plurality of teeth 413 on the cog 412 of the first plate 410. The second plate 420 includes a plurality of openings that enable fasteners to be inserted into to secure the second plate 420 within a recess 260 (shown in FIG. 6) in the first end 210 of the second grip portion 200.

The second plate 420 may be connected to the first plate 410 in a plurality of angular orientations in which the second plurality of teeth 423 engage the first plurality of teeth 413 to selectively angularly retain the second plate 420 with respect to the first plate 410. As discussed above, the first plate is connected to the second end 120 of the first grip portion 100 and the second plate 420 is connected to the first end 210 of the second grip portion 200.

The first plurality of teeth of the cog and the second plurality of teeth of the central opening may be configured to enable the second grip portion to be orientated between −20 degrees offset and 20 degrees offset with respect to the first grip portion. The first plurality of teeth of the cog and the second plurality of teeth of the central opening may be configured to enable the second grip portion to be rotated in 4-degree increments between −20 degrees offset and 20 degrees offset with respect to the first grip portion. The degree of increment may be varied as would be appreciated by one of ordinary skill in the art having the benefit of this disclosure. For example, the teeth 413, 423 may be configured to enable the plates to be rotated in 1-degree increments.

The recess 130 includes a central aperture 132 through which a fastener may be inserted to connect the firearm stock 1000 to a firearm receiver as would be appreciated by one of ordinary skill in the art having the benefit of this disclosure. The recess 130 includes a plurality of openings 131 that enable the insertion of fasteners to secure the first plate 410 of the first connection interface 400 within the recess 130.

The firearm stock 1000 includes a second grip portion 200 having a first end 210, a second end 220, and a first axis of rotation 270. The second grip portion 200 includes a grip portion 230 configured to be gripped by a user. The second grip portion 200 includes an opening 240. A fastener may be inserted through the opening 240 of the second grip portion 200 and the central aperture 132 in the second end 120 of the first grip portion 100 to secure the firearm stock 1000 to a receiver of a firearm. The second grip portion 200 includes a thumb channel 250. The first end 210 of the second grip portion 200 is positioned adjacent to the first grip portion 100. The firearm stock 1000 includes a first connection interface 400 between the first grip portion 100 and the first end 210 of the second grip portion 200. The first connection interface 400 enables the second grip portion 200 to be connected to the first grip portion 100 in more than one angular orientation about the first axis of rotation 270 of the second grip portion 200.

The configuration, size, number, shape, and/or position of the first plate 410, cog 412, first plurality of teeth 413, second plate 420, opening 422, and second plurality of teeth 423 may be varied as would be appreciated by one of ordinary skill in the art having the benefit of this disclosure. For example, the first plate 410 and cog 412 may be connected to the first end 210 of the second grip portion 200 and the second plate 420 with the opening 422 could be connected to the second end 120 of the first grip portion 100. Similarly, different shapes may be used to provide different angular orientations between the two plates 410, 420 as would be appreciated by one of ordinary skill in the art having the benefit of this disclosure.

The first grip portion 100 includes a longitudinal centerline 150. The first axis of rotation 270 may be aligned with the longitudinal centerline 150. The second grip portion 200 includes a second axis of rotation 280. The firearm stock 1000 includes a butt stock 300 positioned adjacent to the second end 220 of the second grip portion 200. The firearm stock 1000 includes a second connection interface 500 between the second end 220 of the second grip portion 200 and the butt stock 300. The second connection interface 500 enables the second grip portion 200 to be connected to the butt stock 300 in more than one angular orientation about the second axis of rotation 280 of the second grip portion 200. The butt stock 300 has a first end 310 and a second end 320. The butt stock 300 may include a comb 340 and a butt pad 350 located at the second end 320 of the butt stock 300.

The second connection interface 500 includes an insert 510 and a connector 520. The connector 520 includes a projection 522 (shown on FIG. 7A) on an end plate 521. The projection 522 includes a third plurality of teeth 523 and an aperture 524 through the projection 522. The connector 520 includes a cylinder 525 connected to the end plate 521 opposite the projection 522. The cylinder 525 includes an opening 526 aligned with the aperture 524 through the projection 522. Two arms 527 are connected to the end plate 521 opposite of the projection 522. The arms 527 are used to connect the connector 520 to the butt stock 300. The arms 527 includes apertures 528 for the insertion of fasteners to connect the connector 520 to the butt stock 300.

The insert 510 of the second connection interface 500 is connected to the second end 220 of the second grip portion 200. A portion 511 of the insert 510 is positioned within a recess 290 in the second end 220 of the second grip portion 200. The insert 510 includes a central aperture 513 and two adjacent apertures 512 through which fasteners may be inserted to connect the insert 510 and the second connection interface 500 to the second end 220 of the second grip portion 200. A fastener 295 is inserted into the central aperture 513. The insert 510 of the second connection interface 500 includes a circular recess 514. The circular recess 514 includes a fourth plurality of teeth 515. The fourth plurality of teeth 515 are configured to engage the third plurality of teeth 523 of the projection 522.

The projection 522 may be inserted into the circular recess 514 in a plurality of angular orientations in which the fourth plurality of teeth 515 engage the third plurality of teeth 523 to selectively retain the projection 522 in place with respect to the circular recess 514. The third plurality of teeth 523 of the projection 522 and the fourth plurality of teeth 515 of the circular recess 514 may be configured to enable the second grip portion 200 to be orientated between −20 degrees offset and 20 degrees offset with respect to the butt stock 300. The third plurality of teeth 523 of the projection 522 and the fourth plurality of teeth 515 of the circular recess 514 may be configured to enable the second grip portion 200 to be rotated in 4-degree increments between −20 degrees offset and 20 degrees offset with respect to the butt stock 300. The degree of increment may be varied as would be appreciated by one of ordinary skill in the art having the benefit of this disclosure. For example, the teeth 515, 523 may be configured to enable the plates to be rotated in 1-degree increments.

The configuration, size, number, shape, and/or position of the insert 510, circular recess 514, fourth plurality of teeth 515, connector 520, projection 522, and third plurality of teeth 523 may be varied as would be appreciated by one of ordinary skill in the art having the benefit of this disclosure. For example, the insert 510 and circular recess 514 may be connected to the butt stock 300 and the connector 520 with the projection 522 could be connected to the second end 120 of the second grip portion 200. Similarly, different shapes may be used to provide different angular orientations between the connector 520 and the insert 510 as would be appreciated by one of ordinary skill in the art having the benefit of this disclosure.

Figure 6:
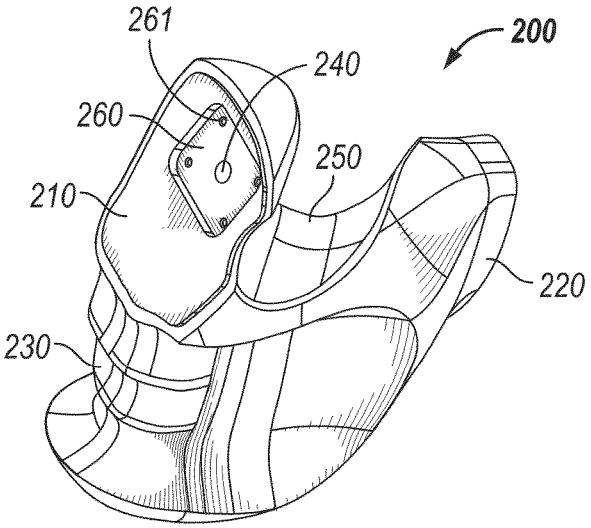
FIG. 6 shows a perspective view of an embodiment of a second grip portion.

FIG. 6 shows a perspective view of an embodiment of a second grip portion 200. The second grip portion 200 has a first end 210 and a second end 220. The second grip portion 200 includes a grip 230 that enables a user to grip the firearm stock assembly 1000. The second grip portion 200 includes a thumb slot 250. The second grip portion 200 includes a recess 260 in the first end 210. The recess 260 is configured to receive a second plate 420 of a first connection interface 400 as discussed herein. The recess 260 includes an aperture, or opening, 240 for the passage of a fastener as well as a plurality of openings 261 that enable the second plate 420 to be secured to the first end 210 of the second grip portion 200.

Figure 7A:
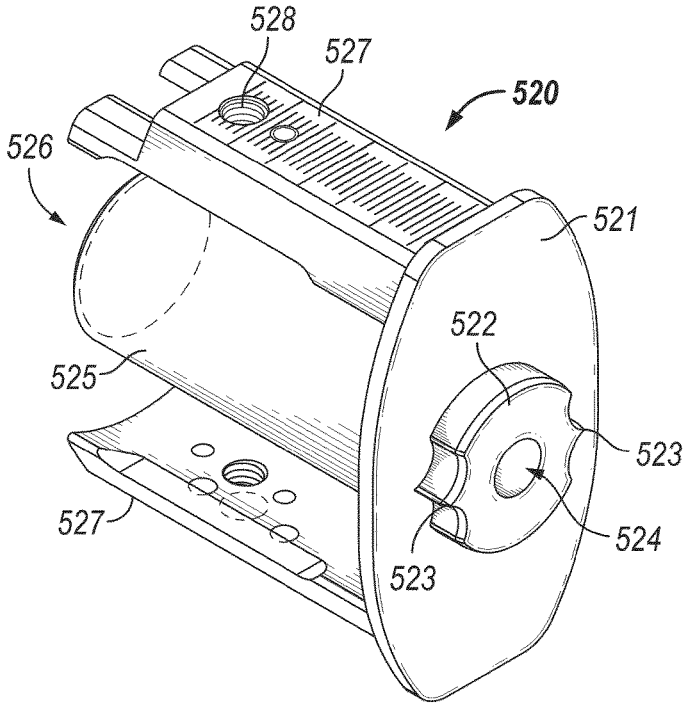
FIGS. 7A-7D show an embodiment of a portion of a second connection interface.
Figure 7B:
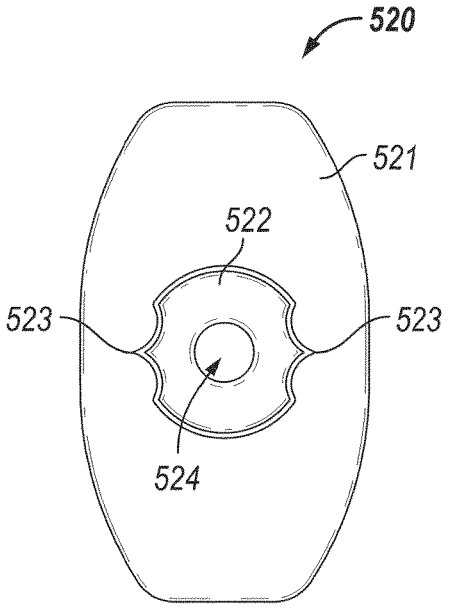

FIG. 7A shows a perspective view of an embodiment of a connector 520 of the second connection interface 500. FIG. 7B shows an end view of the connector 520. The connector 520 includes a projection 522 on an end plate 521. The projection 522 includes a third plurality of teeth 523 on the projection 522 and an aperture 524 through the projection 522. The connector 520 includes a cylinder 525 connected to the end plate 521 opposite the projection 522. The cylinder 525 includes an opening 526 aligned with the aperture 524 through the projection 522. Two arms 527 are connected to the end plate 521 opposite of the projection 522. The arms 527 are used to connect the connector 520 to the butt stock 300. The arms 527 includes apertures 528 for the insertion of fasteners to connect the connector 520 to the butt stock 300 (shown in FIG. 4).

Figure 7C:
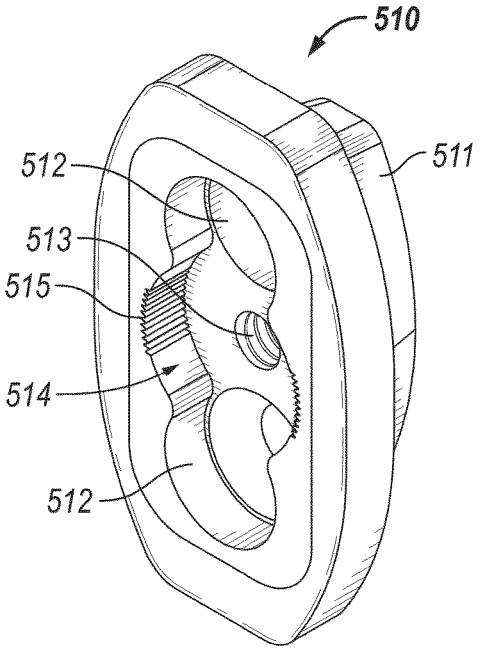
Figure 7D:
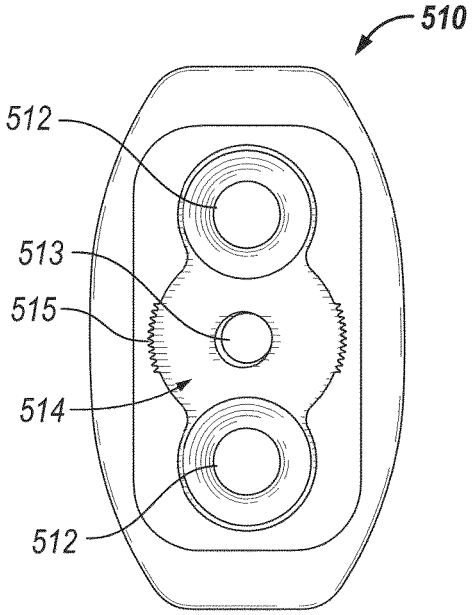

FIG. 7C shows a perspective view of an embodiment of an insert 510 of the second connection interface 500. FIG. 7D shows an end view of the insert 510. A portion 511 of the insert 510 is positioned within a recess in the second end 220 of the second grip portion 200 as discussed herein. The insert 510 includes a central aperture 513 and two adjacent apertures 512 through which fasteners may be inserted to connect the insert 510 and the second connection interface 500 to the second end 220 of the second grip portion 200. The insert 510 of the second connection interface 500 includes a circular recess 514. The circular recess 514 includes a fourth plurality of teeth 515. The fourth plurality of teeth 515 are configured to engage the third plurality of teeth 523 of the projection 522 on the connector 520. The engagement of the third plurality of teeth 523 with the fourth plurality of teeth 515 enable the second grip portion 200 to be positioned in different angular orientations with respect to the butt stock 300 as discussed herein.

Figure 8A:
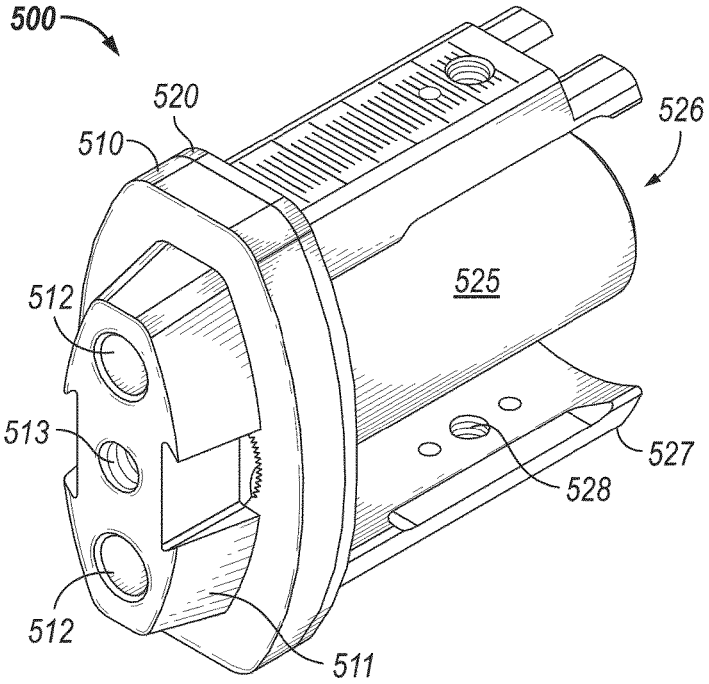
FIGS. 8A and 8B show an embodiment of a second connection interface in a first angular orientation.
Figure 8B:
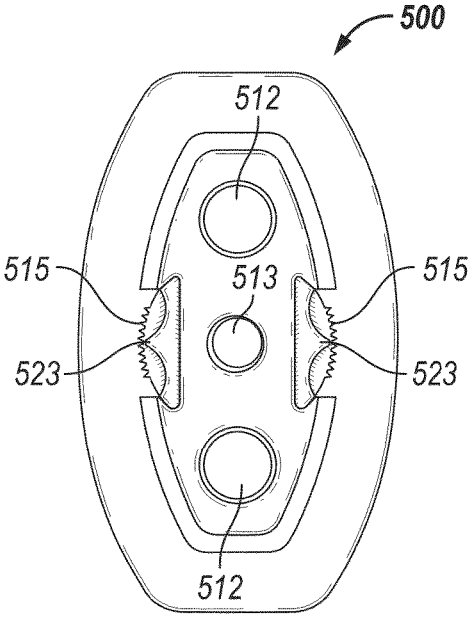

FIGS. 8A and 8B show the connector 520 and the insert 510 of the second connection interface 500 in a first angular orientation. In the first angular orientation, the connector 520 is aligned with the insert 510. Thus, the second grip portion 200 would be vertically aligned with the butt stock 300 and the second connection interface 500 would not provide any compensation for a cant of the firearm connected to the firearm stock 1000.

Figure 9A:
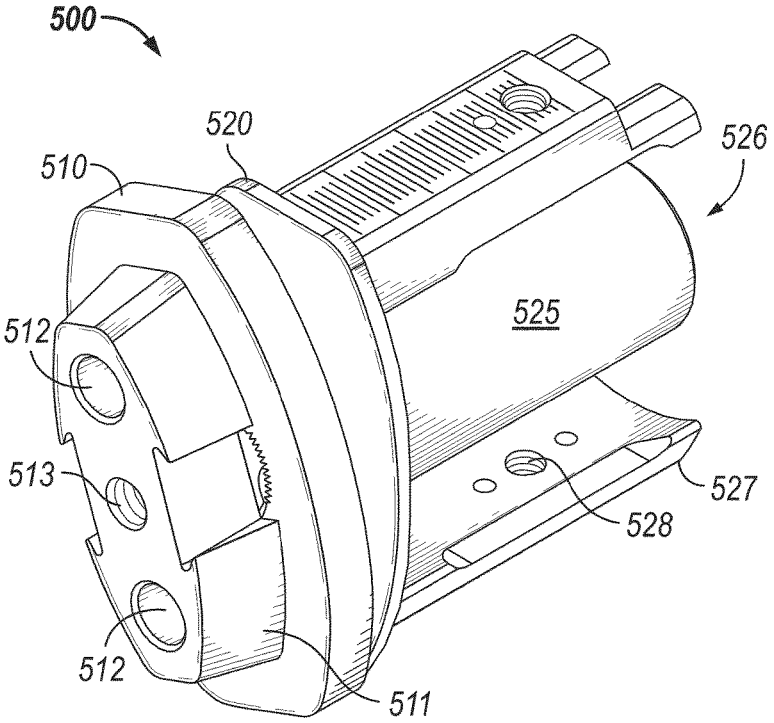
FIGS. 9A and 9B show an embodiment of a second connection interface in a second angular orientation.
Figure 9B:
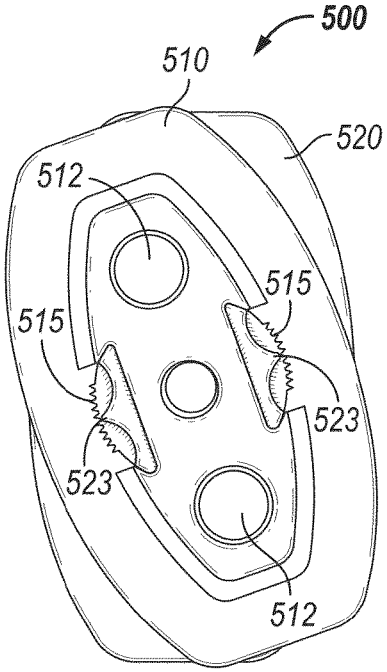

FIGS. 9A and 9B show the connector 520 and the insert 510 of the second connection interface 500 in a second angular orientation. In the second angular orientation, the insert 510 has been rotated clockwise with respect to the connector 520 when viewed from the end of the connector 520. In the second angular orientation, the second connection interface 500 would compensate for a counter-clockwise cant of the firearm connected to the firearm stock 1000.

Figure 10A:
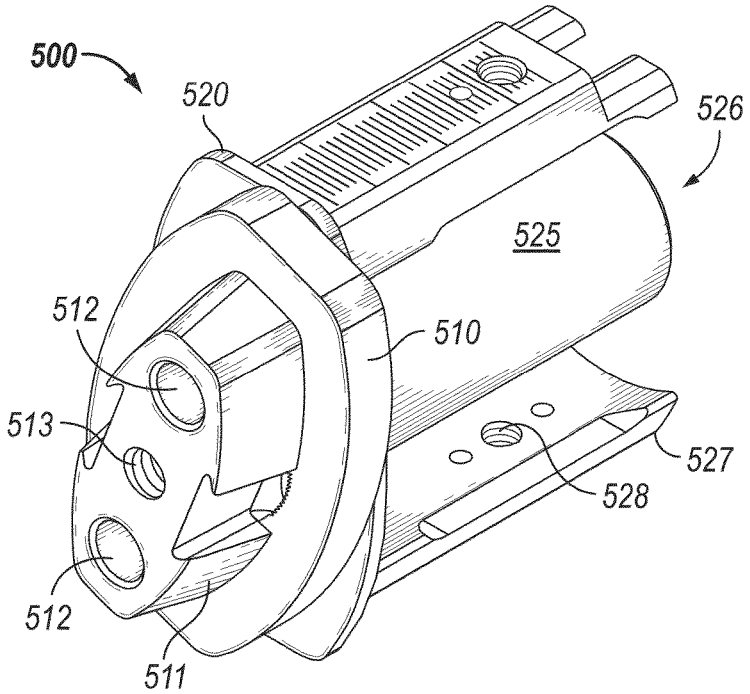
FIGS. 10A and 10B show an embodiment of a second connection interface in a third angular orientation.
Figure 10B:
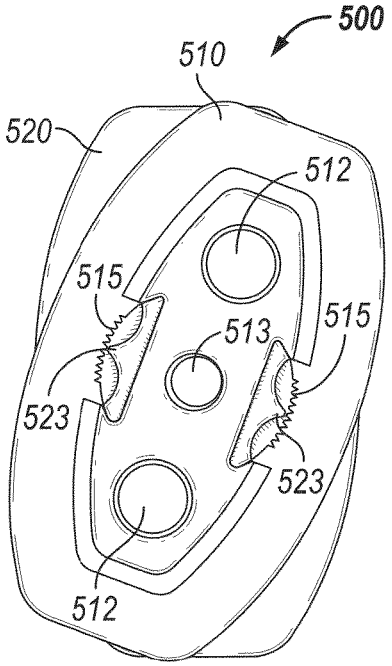

FIGS. 10A and 10B show the connector 520 and the insert 510 of the second connection interface 500 in a third angular orientation. In the third angular orientation, the insert 510 has been rotated counter-clockwise with respect to the connector 520 when viewed from the end of the connector 520. In the third angular orientation, the second connection interface 500 would compensate for a clockwise cant of the firearm connected to the firearm stock 1000.

Figure 11A:
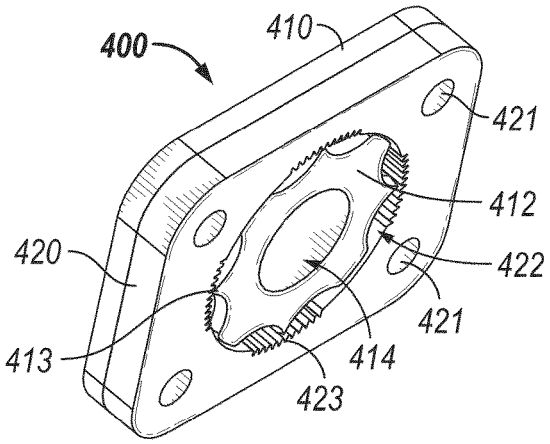
FIGS. 11A and 11B show an embodiment of a first connection interface in a first angular orientation.
Figure 11B:
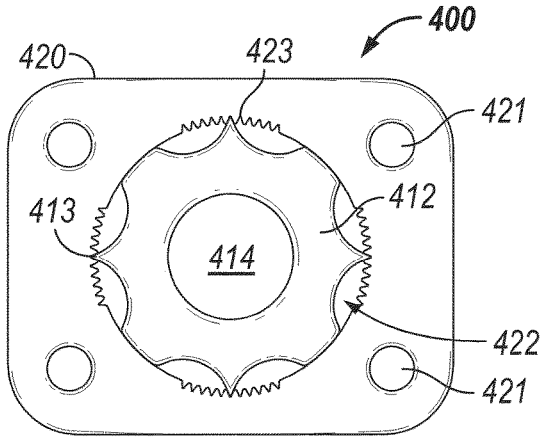

FIGS. 11A and 11B show the first plate 410 and the second plate 420 of the first connection interface 400 in a first angular orientation. In the first angular orientation, the first plate 410 is aligned with the second plate 420. Thus, the second grip portion 200 would be vertically aligned with the first grip portion 100 and the first connection interface 400 would not provide any compensation for a cant of the firearm connected to the firearm stock 1000.

Figure 12A:
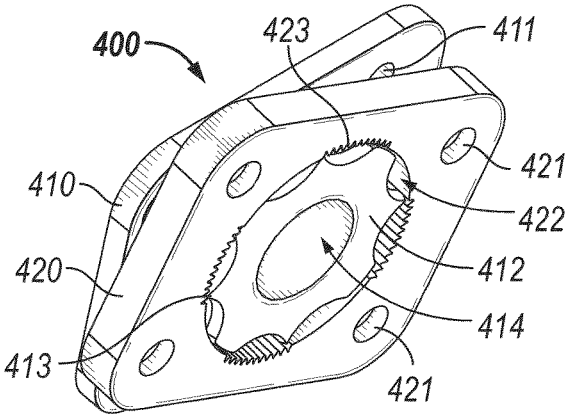
FIGS. 12A and 12B show an embodiment of a first connection interface in a second angular orientation.
Figure 12B:
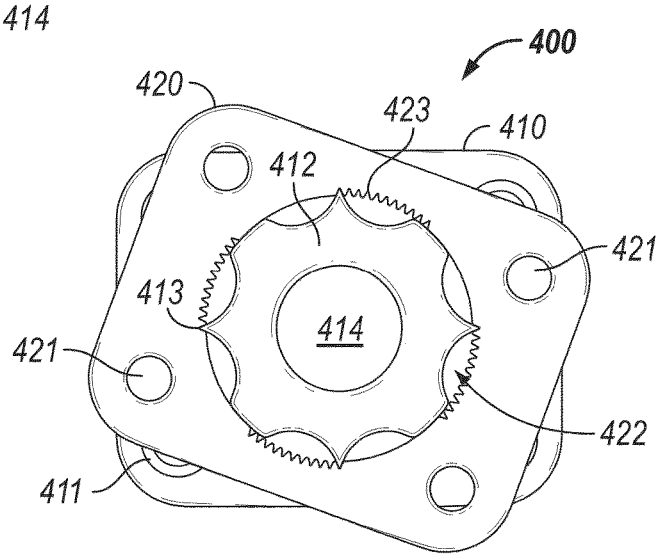

FIGS. 12A and 12B show the first plate 410 and the second plate 420 of the first connection interface 400 in a second angular orientation. In the second angular orientation, the second plate 420 has been rotated clockwise with respect to the first plate 410 when viewed from the end of the stock 1000. In the second angular orientation, the first connection interface 400 would compensate for a counter-clockwise cant of the firearm connected to the firearm stock 1000.

Figure 13A:
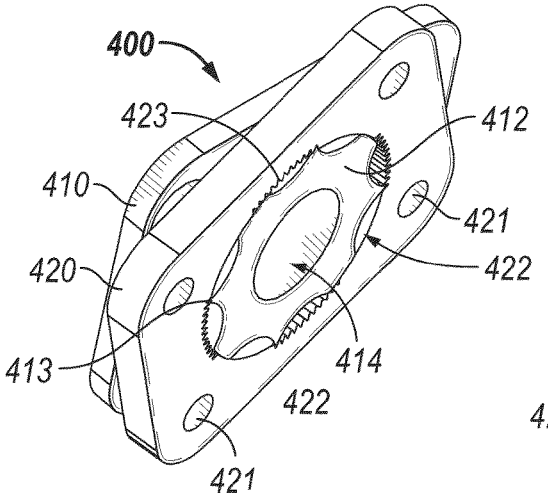
FIGS. 13A and 13B show an embodiment of a first connection interface in a third angular orientation.
Figure 13B:
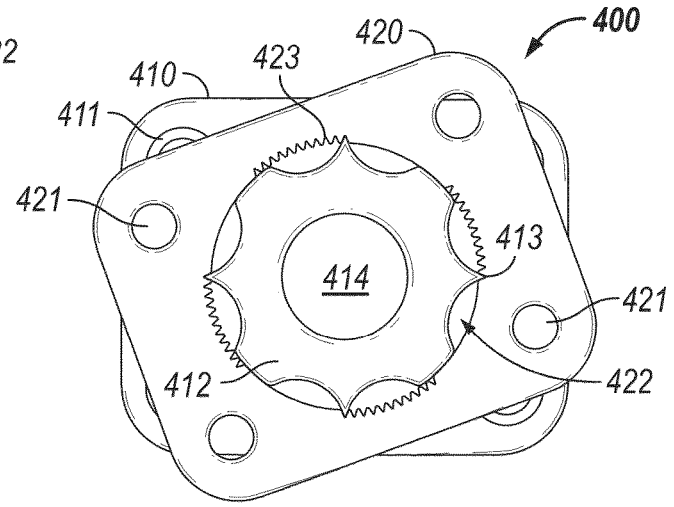

FIGS. 13A and 13B show the first plate 410 and the second plate 420 of the first connection interface 400 in a third angular orientation. In the third angular orientation, the second plate 420 has been rotated counter-clockwise with respect to the first plate 410 when viewed from the end of the stock 1000. In the third angular orientation, the first connection interface 400 would compensate for a clockwise cant of the firearm connected to the firearm stock 1000.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A firearm stock comprising:

a first grip portion, the first grip portion being configured to attach to a firearm receiver;

a second grip portion having a first end, a second end, and a first axis of rotation, the first end being positioned adjacent to the first grip portion;

a first connection interface between the first grip portion and the first end of the second grip portion, wherein the first connection interface enables the second grip portion to be connected to the first grip portion in more than one angular orientation about the first axis of rotation of the second grip portion; and the first grip portion includes a longitudinal centerline, wherein the first axis of rotation is aligned with the longitudinal centerline.

2. The firearm stock of claim 1, further comprising:

the second grip portion having a second axis of rotation;

a butt stock being positioned adjacent to the second end of the second grip portion; and a second connection interface between the second end of the second grip portion and the butt stock, wherein the second connection interface enables the second grip portion to be connected to the butt stock in more than one angular orientation about the second axis of rotation of the second grip portion.

3. The firearm stock of claim 2, wherein the first connect interface comprises:

a first plate;

a cog on a surface of the first plate, the cog includes a first plurality of teeth;

a second plate, the second plate having a central opening, the central opening includes a second plurality of teeth along the central opening, the second plurality of teeth are configured to engage the first plurality of teeth on the cog; and wherein the second plate may be connected to the first plate in a plurality of angular orientations in which the second plurality of teeth engage the first plurality of teeth to selectively angularly retain the second plate with respect to the first plate.

4. The firearm stock of claim 3, wherein the first plate is connected to the first grip portion and wherein the second plate is connected to the first end of the second grip portion.

5. The firearm stock of claim 4, wherein the first plurality of teeth of the cog and the second plurality of teeth of the central opening are configured to enable the second grip portion to be orientated between−20 degrees offset and 20 degrees offset with respect to the first grip portion.

6. The firearm stock of claim 4, wherein the first plurality of teeth of the cog and the second plurality of teeth of the central opening are configured to enable the second grip portion to be rotated in 4-degree increments between−20 degrees offset and 20 degrees offset with respect to the first grip portion.

7. The firearm stock of claim 4, wherein the second connection interface comprises:

a projection, the projection includes a third plurality of teeth;

a circular recess, the circular recess includes a fourth plurality of teeth, the fourth plurality of teeth are configured to engage the third plurality of teeth of the projection; and wherein the projection may be inserted into the circular recess in a plurality of angular orientations in which the fourth plurality of teeth engage the third plurality of teeth to selectively retain the projection in place with respect to the circular recess.

8. The firearm stock of claim 7, wherein the circular recess is positioned on the second end of the second grip portion and wherein the projection is on an end of the butt stock.

9. The firearm stock of claim 8, wherein the third plurality of teeth of the projection and the fourth plurality of teeth of the circular recess are configured to enable the second grip portion to be orientated between−20 degrees offset and 20 degrees offset with respect to the butt stock.

10. The firearm stock of claim 9, wherein the third plurality of teeth of the projection and the fourth plurality of teeth of the circular recess are configured to enable the second grip portion to be rotated in 4-degree increments between−20 degrees offset and 20 degrees offset with respect to the butt stock.

11. A firearm stock system comprising:

a first grip portion, the first grip portion having a first end and a second end, the first grip portion being configured to attach to a firearm receiver;

a second grip portion having a first end, a second end, a first axis of rotation, and a second axis of rotation, the first end being positioned adjacent to the first grip portion;

a first connection interface between the first grip portion and the first end of the second grip portion, wherein the first connection interface enables the second grip portion to be connected to the first grip portion in more than one angular orientation about the first axis of rotation of the second grip portion;

a butt stock, having a first end and a second end, the butt stock being positioned adjacent to the second end of the second grip portion;

a second connection interface between the second end of the second grip portion and the butt stock, wherein the second connection interface enables the second grip portion to be connected to the butt stock in more than one angular orientation about the second axis of rotation of the second grip portion; and a length from the first end of the first grip portion and the second end of the butt stock, wherein the length does not change when the second grip portion is rotated about the first axis of rotation and is rotated about the second axis of rotation.

12. The firearm stock system of claim 11, wherein the first connect interface comprises:

a first plate;

a cog on a surface of the first plate, the cog includes a first plurality of teeth;

a second plate, the second plate having a central opening, the central opening includes a second plurality of teeth along the central opening, the second plurality of teeth are configured to engage the first plurality of teeth on the cog; and wherein the second plate may be connected to the first plate in a plurality of angular orientations in which the second plurality of teeth engage the first plurality of teeth to selectively angularly retain the second plate with respect to the first plate.

13. The firearm stock system of claim 12 wherein the second connection interface comprises:

a projection, the projection includes a third plurality of teeth;

a circular recess, the circular recess includes a fourth plurality of teeth, the fourth plurality of teeth are configured to engage the third plurality of teeth of the projection; and wherein the projection may be inserted into the circular recess in a plurality of angular orientations in which the fourth plurality of teeth engage the third plurality of teeth to selectively retain the projection in place with respect to the circular recess.

14. The firearm stock system of claim 13, wherein the first plurality of teeth of the cog and the second plurality of teeth of the central opening are configured to enable the second grip portion to be orientated between−20 degrees offset and 20 degrees offset with respect to the first grip portion.

15. The system of claim 14, wherein the third plurality of teeth of the projection and the fourth plurality of teeth of the circular recess are configured to enable the second grip portion to be orientated between−20 degrees offset and 20 degrees offset with respect to the butt stock.

* * * * *